US008641310B2

(12) United States Patent
Pennella

(10) Patent No.: US 8,641,310 B2
(45) Date of Patent: Feb. 4, 2014

(54) REPLACEMENT CARTRIDGE FOR A RAZOR ASSEMBLY

(75) Inventor: Andrew J Pennella, Milford, CT (US)

(73) Assignee: Eveready Battery ComaPNY, Inc, St. Louis, MO (US)

( * ) Notice: Subject to any disclaimer, the term of this patent is extended or adjusted under 35 U.S.C. 154(b) by 436 days.

(21) Appl. No.: 13/089,427

(22) Filed: Apr. 19, 2011

(65) Prior Publication Data

US 2012/0266466 A1 Oct. 25, 2012

(51) Int. Cl.
*B26B 21/00* (2006.01)
*A45D 27/28* (2006.01)

(52) U.S. Cl.
USPC ..... 401/195; 401/132; 401/133; 30/535; 30/538; 604/3

(58) Field of Classification Search
USPC ..... 401/132, 133; 30/535, 538; 604/3
See application file for complete search history.

(56) References Cited

U.S. PATENT DOCUMENTS

| | | | | |
|---|---|---|---|---|
| 1,556,269 | A | 10/1925 | Warming | |
| 1,867,980 | A | 7/1932 | Melka | |
| 2,131,498 | A | 9/1938 | Chandler et al. | |
| 2,327,192 | A | 8/1943 | Keene | |
| 2,686,361 | A | 8/1954 | Resnick et al. | |
| 2,786,270 | A | 3/1957 | Orlando et al. | |
| 2,839,224 | A | 6/1958 | Lipka | |
| 3,176,391 | A | 4/1965 | Resnick et al. | |
| 3,299,506 | A | 1/1967 | Gwinn | |
| 4,696,106 | A | 9/1987 | Cross et al. | |
| 4,813,138 | A | 3/1989 | Chen | |
| 4,868,982 | A * | 9/1989 | McComas | 30/41 |
| 4,888,868 | A * | 12/1989 | Pritchard | 30/41 |
| 5,072,512 | A | 12/1991 | Noujain | |
| RE33,860 | E * | 3/1992 | Chen | 30/41 |
| 5,133,130 | A | 7/1992 | Podolsky | |
| 5,134,775 | A | 8/1992 | Althaus et al. | |
| 5,855,066 | A * | 1/1999 | Manger | 30/41 |
| 6,910,274 | B1 * | 6/2005 | Pennella et al. | 30/41 |
| 6,925,716 | B2 * | 8/2005 | Bressler et al. | 30/41 |
| 6,990,740 | B2 * | 1/2006 | Follo et al. | 30/532 |
| 7,043,841 | B2 | 5/2006 | Franzini et al. | |
| 7,121,754 | B2 * | 10/2006 | Bressler et al. | 401/264 |
| 7,137,203 | B2 * | 11/2006 | Bressler et al. | 30/41 |
| 7,178,291 | B2 * | 2/2007 | Vasquez | 49/82.1 |

(Continued)

FOREIGN PATENT DOCUMENTS

| | | | |
|---|---|---|---|
| EP | 427889 | A | 12/1989 |
| JP | 08276080 | A | 4/1995 |

OTHER PUBLICATIONS

International Search Report of counterpart application PCT/US2009/060424, mailed Mar. 23, 2010.

*Primary Examiner* — David Walczak
*Assistant Examiner* — Joshua Wiljanen
(74) *Attorney, Agent, or Firm* — Energizer Personal Care, LLC

(57) ABSTRACT

A replacement cartridge for a safety razor includes a dispensing head and a reservoir for a flowable shaving aid material. A removable shield is between the reservoir and the dispensing head and the shield interrupts fluid communication between channels of the reservoir and the dispensing head when the shield is in place. Fluid communication is permitted when the shield is removed. Removal of the shield is a onetime event. The shield can be a thermoplastic film. A razor cartridge can be disposed adjacent the dispensing head and the housing of the razor cartridge can be integrally formed with the housing of the dispensing head.

8 Claims, 6 Drawing Sheets

(56) References Cited

U.S. PATENT DOCUMENTS

| | | | | |
|---|---|---|---|---|
| 7,306,392 | B2 | 12/2007 | Mislove | |
| 7,604,623 | B2 * | 10/2009 | Brunner et al. | 604/385.101 |
| 7,651,290 | B2 * | 1/2010 | Bauer et al. | 401/133 |
| 8,157,464 | B2 * | 4/2012 | Prax | 401/133 |
| 2004/0177510 | A1 * | 9/2004 | Pennella | 30/41 |
| 2005/0120561 | A1 * | 6/2005 | Franzini et al. | 30/41 |
| 2005/0138814 | A1 | 6/2005 | Pennella et al. | |
| 2007/0048063 | A1 * | 3/2007 | Bauer et al. | 401/7 |
| 2008/0216322 | A1 | 9/2008 | Molema et al. | |
| 2010/0014907 | A1 * | 1/2010 | Richmond et al. | 401/130 |
| 2010/0074671 | A1 * | 3/2010 | Prax | 401/133 |

* cited by examiner

REPLACEMENT CARTRIDGE FOR A RAZOR ASSEMBLY

CROSS REFERENCE TO RELATED APPLICATIONS

This application claims the benefit of International Application PCT/US2009/060424, filed Oct. 13, 2009, which claims the benefit of U.S. provisional patent application Ser. No. 61/107,753, filed Oct. 23, 2008, both incorporated herein for reference in their entireties.

BACKGROUND

1. Technical Field

This disclosure relates generally to wet shaving devices, and more specifically to safety razors having a dispensing head in fluid communication with a reservoir of a flowable shaving aid material and a removable shield therebetween.

2. Background Information

Many modern shaving implements, commonly known as wet shave or safety razors, include a disposable razor cartridge, releasably connected to a reusable handle. Other modern safety razors have a handle and a razor cartridge that are intended to be permanently coupled and disposed of as a single unit. The cartridge comprises a housing having at least one razor blade with a cutting edge disposed therein.

There have been many proposals to provide a safety razor with a dispensing system for delivering to the skin during shaving a flowable shaving aid material, such as shave foam, shave cream or other lubricating fluid, or skin care materials that cleanse or otherwise care for the skin. The material is stored within a reservoir ready for use. The flowable shaving aid material can replace a customary shaving preparation or can be used in addition thereto. The reservoir is in fluid communication with a dispensing head to deliver the shaving aid material to the skin surface of a user during a normal shaving operation. The dispensing head can include a valve arrangement to regulate the flow of the shaving aid material and the dispensing head can be integral with the razor cartridge or situated adjacent thereto. Several different types of dispensing head have been proposed, including those utilizing a capillary wick, e.g. as disclosed in U.S. Pat. No. 5,134,775 to Althaus et al. and an array of apertures, valves or rollers that partially or completely surround the cutting edge(s), e.g. as disclosed respectively in U.S. Pat. No. 7,137,203 to Bressler et al., U.S. Pat. No. 7,043,841 to Franzini et al. and U.S. Patent application publication 2005/0138814.

In the course of, for example, shipment of such razors between the manufacturer and the retail outlet or end user, certain changes in meteorological conditions can occur such as changes in barometric pressure and/or ambient temperature. Such changes can lead to changes in properties of a shaving aid material stored therein e.g. viscosity changes or changes in volume due to thermal expansion or contraction. Furthermore, similar differential dimensional changes due to thermal expansion can affect the effectiveness of various valve arrangements where provided. One effect of such changes is that the shaving aid material can drool or otherwise exude in small quantities which can be unattractive and make the razor undesirable for a potential purchaser. In U.S. Pat. No. 7,306,392 to Mislove a shaving head is filled with a quantity of shaving soap and enclosed by a removable tape prior to use. However, some dispensing heads of e.g. the aforementioned '775 or '841 patents or the '814 application have generally non-flat skin contacting surfaces of their dispensing heads due to the nature of the capillary wick or the presence of protruding valves or rollers. Suitably adhering a removable tape to such non-flat surfaces provides manufacturing challenges. In addition any reaction between the shaving aid material and an adhesive coating of the removable tape can result in a reduction of adhesiveness.

SUMMARY

The present disclosure has for its objective to eliminate, or at least substantially alleviate the limitations of the prior art safety razors employing a delivery system for a flowable shaving aid material. A replacement cartridge for such a razor assembly comprises a reservoir adapted to contain the flowable shaving aid material, a dispensing head adapted to deposit the flowable shaving aid material on a skin surface of a user during a normal shaving operation and a removable shield disposed between the reservoir and the dispensing head adapted to prevent flow of the shaving aid material the reservoir until the shield is removed. When the shield is removed, fluid communication is provided between one or more channels of the reservoir and the dispensing head and the shaving aid material can be deposited as described above. A portion of the shield extends outwardly from an opening in a slot or gap between the reservoir and the dispensing head to provide a region that can be gripped by the user for removal of the shield. Removal of the shield is a onetime event. The shield can be integrally formed with a plug and can include a weakened portion, e.g. a notch or a series of perforations therebetween. Application of a predetermined force by the user can cause the shield to separate from the plug in the region of the weakened portion. After separation, the plug is retained in the replacement cartridge and can substantially close the opening of the slot to prevent undesirable flow of the shaving aid material out of the opening.

In other embodiments, the replacement cartridge can include a spring or springs to provide an attractive force between the reservoir and the dispensing head. The spring or springs can be e.g. a helical spring or leaf spring, such as a cantilevered beam that is preferably integrally formed with either the reservoir or the dispensing head. As described above a shield disposed between the reservoir and the dispensing head prevents flow of the shaving aid material from the reservoir until the shield is removed. When the shield is removed the attractive force between the reservoir and the dispensing head closes a gap between the reservoir and the dispensing head to provide fluid communication as previously described and to prevent undesirable flow of the shaving aid material from end(s) of the gap.

The shield is preferably a die-cut biaxiallyoriented polyethylene terephthalate (boPET) polyester film or other suitable film or can be injection molded or extruded from other suitable thermoplastic materials.

The replacement cartridge can include a razor cartridge disposed adjacent the dispensing head. The housing of the dispensing head housing can be integrally formed with the housing of the razor cartridge.

Embodiments of the present disclosure can include one or more of the following advantages. The razor will largely resist changes in meteorological conditions and retain its attractiveness to a potential purchaser. The shield provides a "freshness" indicator to the user.

The above features and advantages of the present disclosure will be more fully understood with reference to the following detailed description when taken in conjunction with the accompanying drawings.

DETAILED DESCRIPTION

Figure 1:
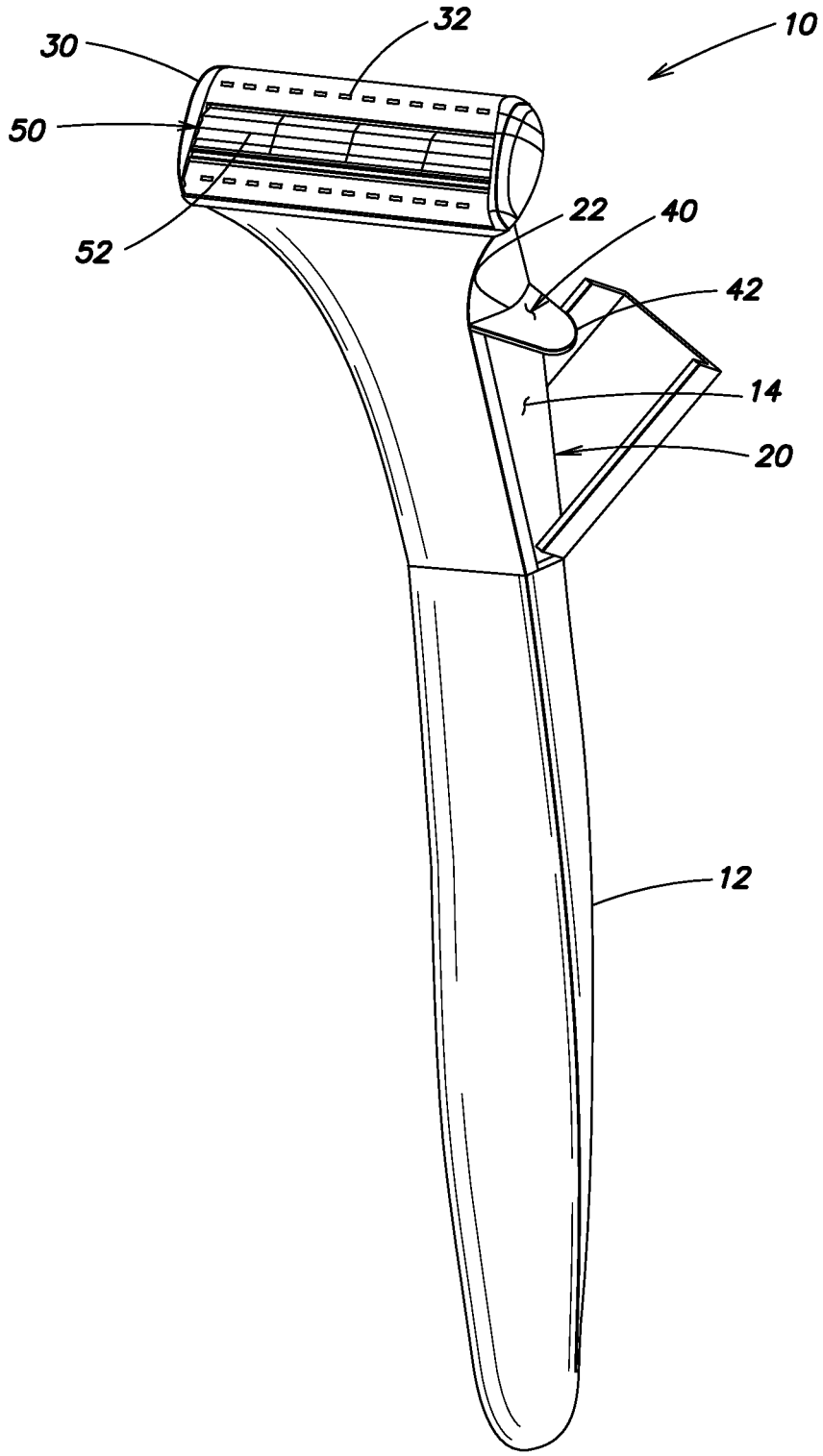
FIG. 1 is a perspective view of a first embodiment of a safety razor of the present disclosure.

Referring now to the drawings and in particular FIG. 1, an exemplary razor assembly 10 is shown comprising a handle 12 and a replacement cartridge 14. In FIG. 1 the replacement cartridge 14 is shown partially disassembled from the handle 12 purely for convenience of illustration. The replacement cartridge 14 comprises a reservoir 20 adapted to contain a flowable shaving aid material that can be as known in the art and a dispensing head 30 adapted to deposit the flowable shaving aid material on a skin surface of a user during a normal shaving operation. A removable shield 40 having a user grippable portion 42 is disposed at an interface region 22 between the reservoir and the dispensing head. In the embodiment depicted the dispensing head 30 includes a plurality of ports, valves or wicks 32, or combinations thereof, to regulate the flow of shaving aid material during use. These ports, valves or wicks can be as disclosed in U.S. Pat. No. 5,134,775 to Althaus et al., U.S. Pat. No. 7,137,203 to Bressler et al., U.S. Pat. No. 7,043,841 to Franzini et al. and U.S. Patent application publication 2005/0138814, the disclosures of which are hereby incorporated by reference in their entireties. The ports, valves or wicks 32 can be disposed to partially or completely surround cutting edges 52 of a razor cartridge 50.

Figure 2A:
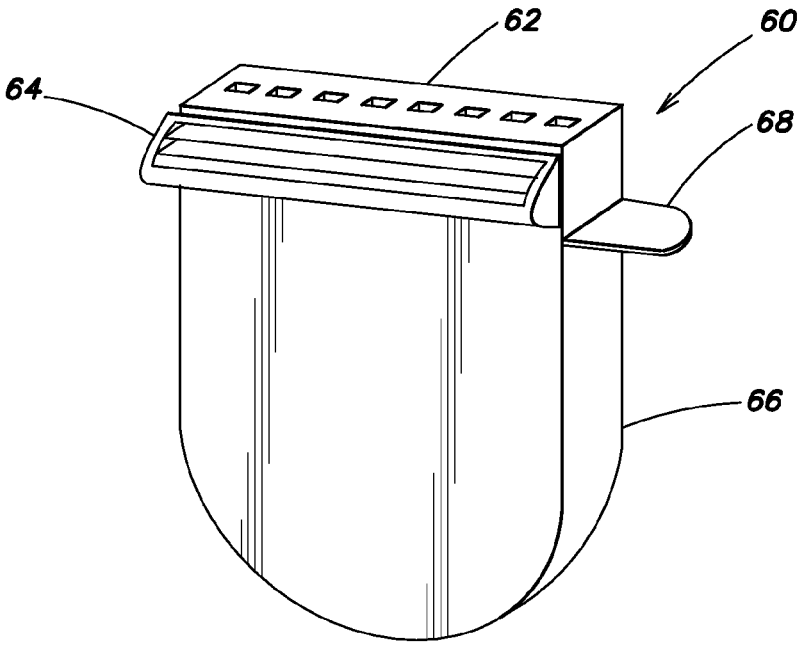
FIG. 2A is a perspective view of an embodiment of a replacement cartridge of the present disclosure.

Referring additionally now to FIG. 2A an embodiment of a replaceable cartridge 60 generally as previously described, is depicted having a dispensing head 62 disposed adjacent a razor cartridge 64. A reservoir 66 is connected to the dispensing head and a shield 68 is disposed therebetween as will be discussed later in the present disclosure.

Figure 2B:
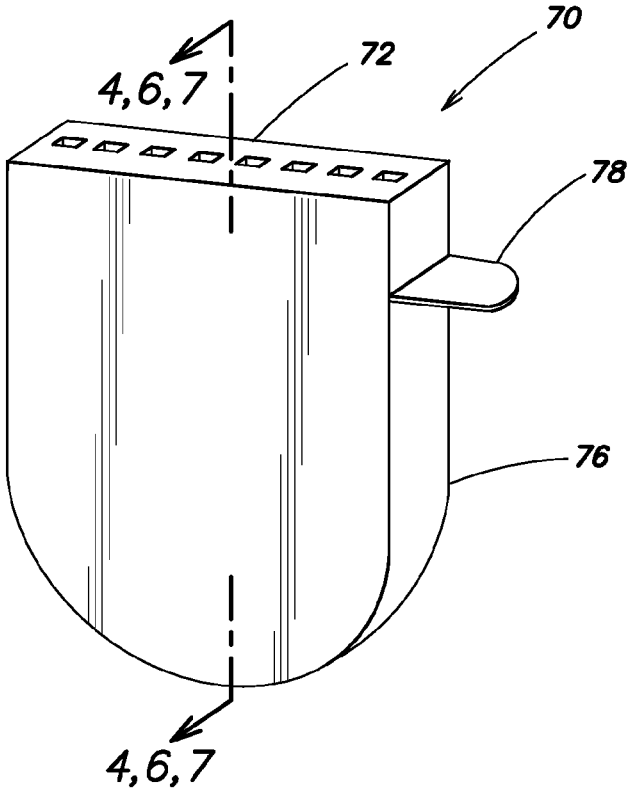
FIG. 2B is a perspective view of another embodiment of a replacement cartridge of the present disclosure.

Referring additionally now to FIG. 2B another embodiment of a replaceable cartridge 70 is depicted having a dispensing head 72, a reservoir 76 connected to the dispensing head and a shield 78 disposed therebetween.

Figure 3:
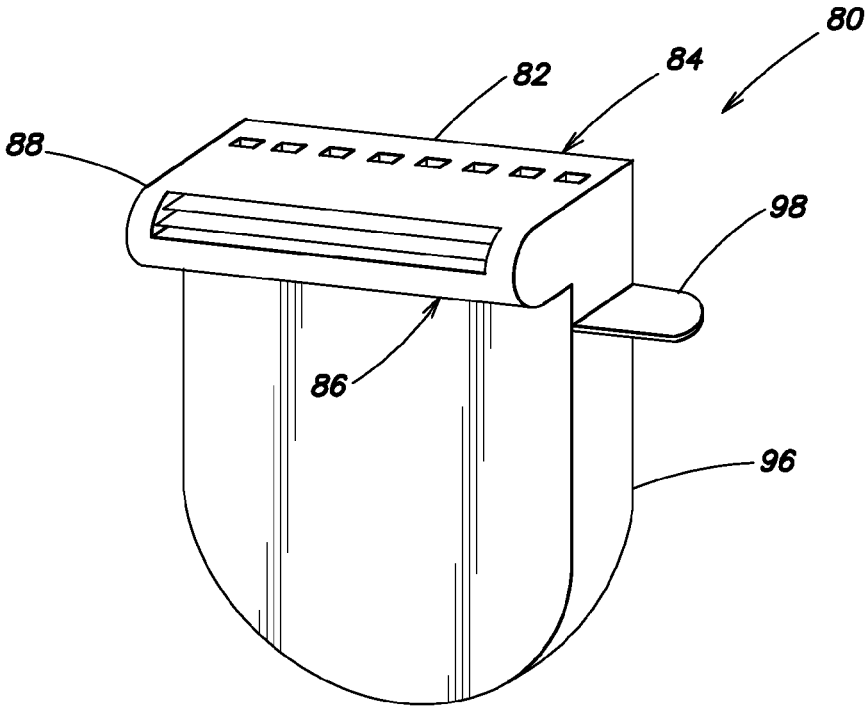
FIG. 3 is a perspective view of a further embodiment of a replacement cartridge of the present disclosure.

Referring additionally now to FIG. 3 a further embodiment of a replaceable cartridge 80 is depicted having a dispensing head 82 with a housing 84 integrally formed with a housing 86 of a razor cartridge 88. A reservoir 96 is connected to the dispensing head and a shield 98 is disposed therebetween.

Figure 5A:
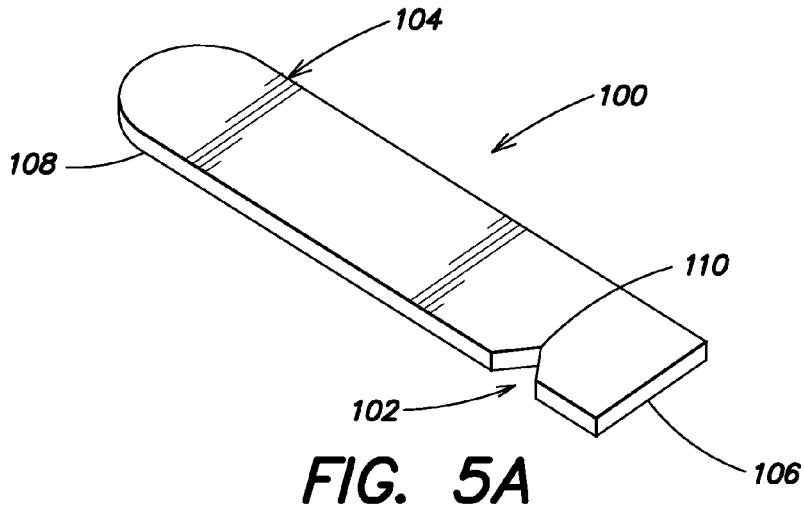
FIG. 5A is a perspective view of an embodiment of a shield of the present disclosure.
Figure 5B:
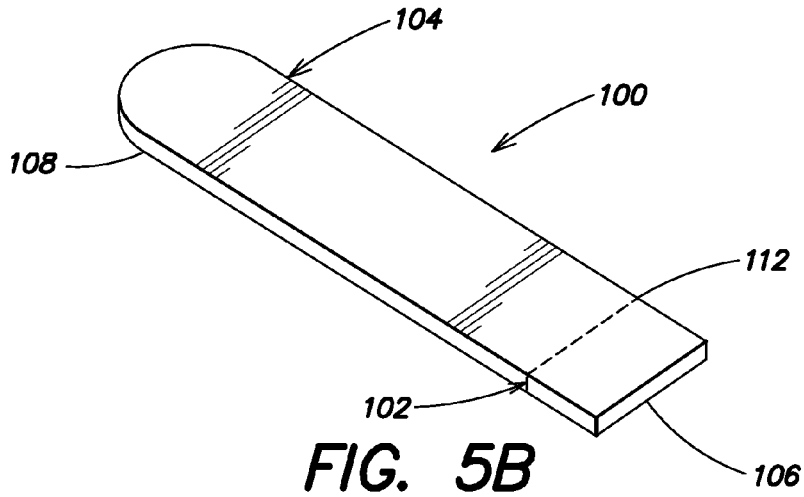
FIG. 5B is a perspective view of another embodiment of a shield of the present disclosure.
Figure 5C:
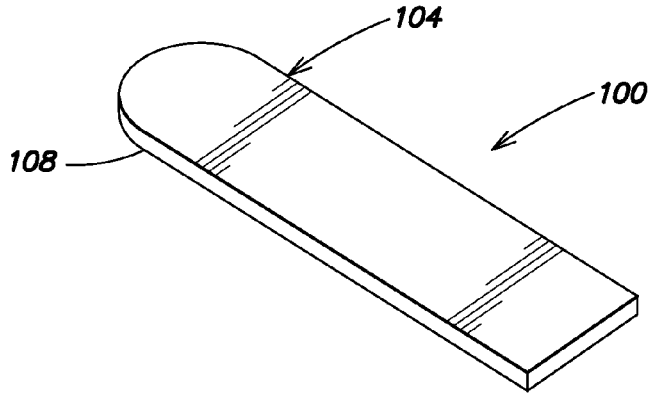
FIG. 5C is a perspective view of a further embodiment of a shield of the present disclosure.

Referring additionally now to FIGS. 5A, 5B and 5C, exemplary embodiments of a shield 100 are depicted. FIG. 5C depicts a unitary shield 104. FIGS. 5A and 5B depict a shield 104 integrally formed with a plug 106 and having a weakened portion 102 therebetween where it is intended the shield and the plug will separate when a predetermined force is applied to a grippable portion 108 of the shield. In FIG. 5A a notch 110 is provided as a so-called stress concentration that will act as an initiation site for a tear to separate the shield from the plug. In FIG. 5B a series of perforations 112 are provided, preferably extending across the width of the shield. The shield is preferably manufactured from a polyester film, most preferably biaxiallyoriented polyethylene terephthalate (boPET) polyester which is readily commercially available under a number of different trade names including MYLAR and MELINEX provided by the DUPONT Company. This material is preferred due to a preferred combination of several properties such as strength, chemical stability and barrier properties. However other film materials can also be provided. The shield is preferably about 0.1 mm thick and is preferably manufactured by die-cutting. The shield can also be manufactured by e.g. injection molding or extrusion processes in which case the thickness and material can be altered to suit the chosen process.

Figure 4:
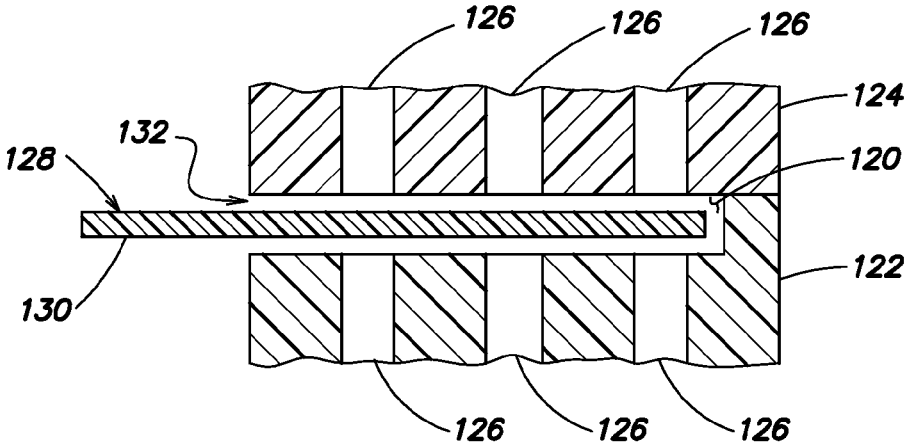
FIG. 4 is an exaggerated schematic cross section taken on lines 4-4 of FIG. 2.

Referring now to FIG. 4, an exaggerated schematic partial cross section taken on lines 4-4 of FIG. 2 is depicted showing a slot 120 in the vicinity of an interface between the reservoir 122 and the dispensing head 124. One or more channels 126 are included in both the housings of the reservoir and dispensing head to provide fluid communication therebetween when the shield 128 is removed by a user by gripping the shield by a grippable portion 130 that extends outwardly from an opening 132 of the slot 120 and applying a predetermined force in an approximately horizontal leftward direction relative to the depicted figure. In this figure the clearances between the component parts are shown enlarged purely for clarity of depiction. In practice, the clearances are preferably sized such that no flowable shaving aid material will pass from the reservoir to the dispensing head or out of the opening until the shield is operated by the application of the aforementioned predetermined force.

Figure 6A:
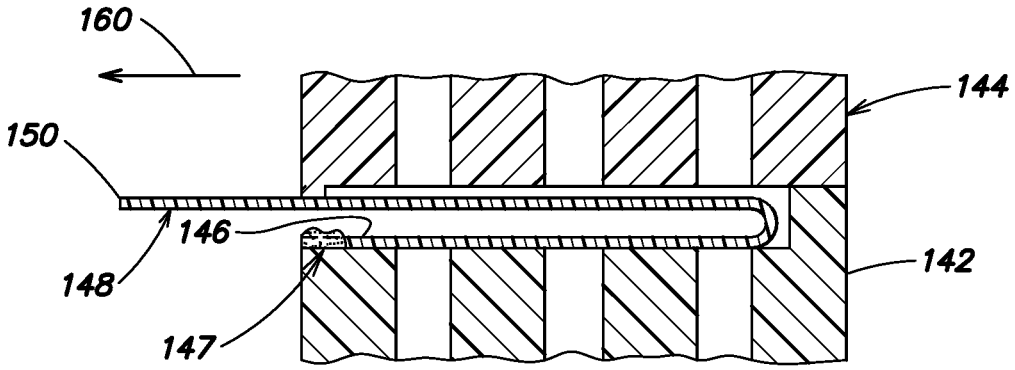
FIGS. 6A and 6B are exaggerated schematic cross sections taken on lines 6-6 of FIG. 2 in respective first and second states.
Figure 6B:
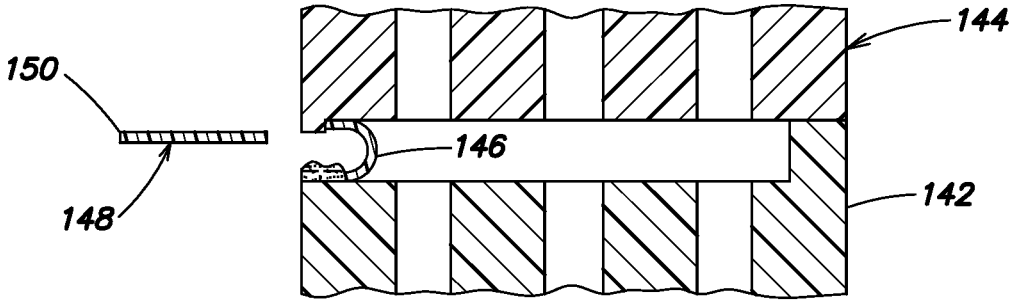

Referring now to FIGS. 6A and 6B, exaggerated schematic partial cross sections taken on lines 6-6 of FIG. 2 are depicted showing the region in the vicinity of an interface between the reservoir 142 and the dispensing head 144. In FIG. 6A this embodiment is generally similar to the depiction of FIG. 4 with the exception that the shield 148 preferably of the type of FIGS. 5A and 5B is disposed between the reservoir and dispensing head in a U-shape and with the plug 146 preferably bonded (e.g. by a suitable adhesive or ultrasonic welding or mechanically attached) to one housing in the region 147. FIG. 6B depicts the result of a predetermined force in approximate direction 160 applied to the grippable portion 150 of the shield 148. The shield 148 has separated from the plug 146 and the plug 146 substantially blocks the opening of the slot to prevent shaving aid material flowing out of the opening. Fluid communication is permitted between channel(s) of the reservoir and channel(s) of the dispensing head.

Figure 7A:
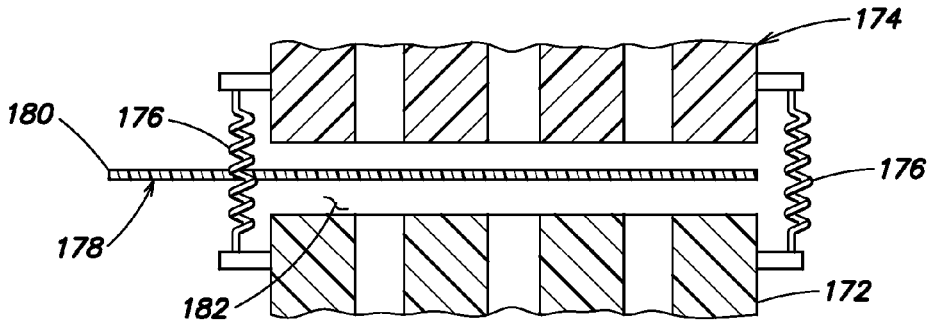
FIGS. 7A and 7B are exaggerated schematic cross sections taken on lines 7-7 of FIG. 2 in respective first and second states.
Figure 7B:
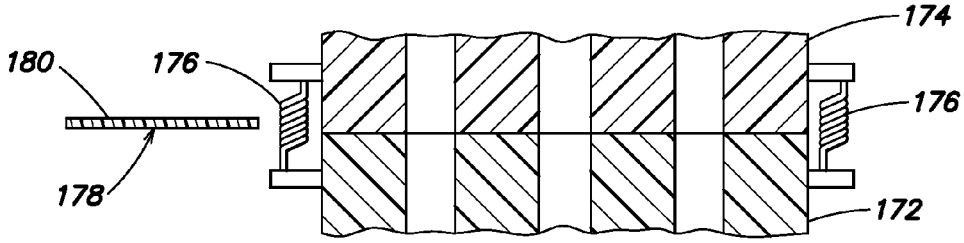

Referring now to FIGS. 7A and 7B, exaggerated schematic partial cross sections taken on lines 7-7 of FIG. 2 are depicted showing the region in the vicinity of an interface between the reservoir 172 and the dispensing head 174. One or more springs 176, e.g. conventional helical springs, are provided between the reservoir and dispensing head to provide an attractive force therebetween. In FIG. 7A a shield 178 preferably of the type of FIG. 5C is provided in a gap 182 between the reservoir and dispensing head. FIG. 7B depicts the result of a predetermined force as previously described being applied to a grippable portion 180 of the shield 178. The shield has been removed and the attractive force between the reservoir and the dispensing head has caused the gap, previously occupied by the shield, to close permitting fluid communication between channel(s) of the reservoir and channel(s) of the dispensing head and preventing shaving aid material flowing in other directions.

Figure 7C:
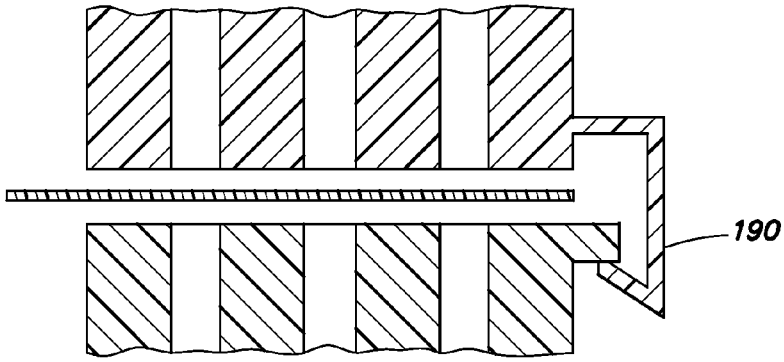
FIG. 7C is an alternate embodiment to that of FIGS. 7A and 7B having a different spring arrangement.

In FIG. 7C a similar embodiment to that of FIGS. 7A and 7B is depicted however the attractive force between the reservoir and the dispensing head is provided by an integrally formed spring, e.g. a cantilevered beam 190.

While various embodiments have been described above, it should be understood that they have been presented by way of example only, and not limitation. For instance, modifications or changes as can be made within the scope of the attached claims and features disclosed in connection with any one embodiment can be used alone or in combination with each feature of the respective other embodiments. Thus, the breadth and scope of any embodiment should not be limited by any of the above described exemplary embodiments, but should be defined only in accordance with the following claims and their equivalents. Those skilled in the art will further recognize that variations and modifications can be made within the scope of the disclosure. For example the U-shape shield of FIG. 6A can be substituted by a straight shield.

What I claim is:

1. A replacement cartridge for a razor assembly, comprising:

a reservoir adapted to contain flowable shaving aid material;

a dispensing head adapted to deposit flowable shaving aid material on a skin surface of a user during a normal shaving operation; and a removable shield, disposed between the reservoir and the dispensing head, adapted to prevent flow of the shaving aid material from one or more channels of the reservoir to one or more channels of the dispensing head when the shield is there disposed; and wherein removal of the shield permits fluid communication between the one or more channels of the reservoir and the one or more channels of the dispensing head;

wherein the shield is disposed in a slot having an opening and a grippable portion of the shield extends outwardly therefrom;

wherein the shield is integrally formed with a plug and a weakened portion is between the shield and the plug;

and wherein the weakened portion comprises a series of perforations.

2. The replacement cartridge of claim 1, wherein removal of the shield is a onetime event.

3. The replacement cartridge of claim 1, wherein the shield comprises a thermoplastic tape.

4. The replacement cartridge of claim 1, wherein when a predetermined removal force is applied to the grippable portion of the shield, the shield can separate from the plug in the vicinity of the weakened portion, the shield can be removed from the replacement cartridge and the plug is retained within the replacement cartridge.

5. The replacement cartridge of claim 4, wherein the plug is retained in the slot adjacent the opening.

6. The replacement cartridge of claim 1, wherein the replacement cartridge further comprises a razor cartridge disposed adjacent the dispensing head.

7. The replacement cartridge of claim 6, wherein the dispensing head includes a dispensing head housing and the razor cartridge includes a razor cartridge housing; and the dispensing head housing is integrally formed with the cartridge housing.

8. The replacement cartridge of claim 1, wherein flowable shaving aid material is disposed in the reservoir.

* * * * *